US006008182A

United States Patent [19]

Salsman et al.

[11] Patent Number: 6,008,182

[45] Date of Patent: Dec. 28, 1999

[54] PREVENTION OF DYE REDEPOSITION IN FABRIC WASHING PROCESSES

[75] Inventors: Robert Keith Salsman, Hoschton; Brian J. Clark, Roswell, both of Ga.

[73] Assignee: Seydel Research, Inc., Atlanta, Ga.

[21] Appl. No.: 09/102,386

[22] Filed: Jun. 22, 1998

[51] Int. Cl.[6] ..... C11D 3/20; C11D 3/37

[52] U.S. Cl. ..... 510/477; 510/283; 510/299; 510/321; 510/327; 510/320; 510/361; 510/488; 521/48; 521/48.5; 528/296; 528/300; 528/272; 528/308; 528/308.1; 524/601; 524/605; 525/444; 525/448

[58] Field of Search ..... 510/283, 327, 510/299, 321, 361, 477, 320, 488; 521/48, 48.5; 528/296, 300, 272, 308, 308.1; 525/444, 448; 524/601, 605

[56] References Cited

U.S. PATENT DOCUMENTS

| | | | |
|---|---|---|---|
| 3,962,152 | 6/1976 | Nicol et al. | 252/551 |
| 4,116,885 | 9/1978 | Derstadt et al. | 252/532 |
| 4,125,370 | 11/1978 | Nicol | 8/137.5 |
| 4,977,191 | 12/1990 | Salsman | 521/48 |
| 5,786,318 | 7/1998 | Blokzijl et al. | 510/289 |
| 5,789,366 | 8/1998 | Blokzijl et al. | 510/292 |

*Primary Examiner*—Yogendra Gupta
*Assistant Examiner*—Gregory R. DelCotto
*Attorney, Agent, or Firm*—Isaac Angres; Cort Flint

[57] ABSTRACT

A process for preventing dye redeposition during the washing of a dyed fabric or garment made from natural fibers, which process incorporates as a dye redeposition inhibiting agent, a water-soluble or water-dispersible polyester resin composition comprising a reaction product of 20%–50% by weight of terephthalate polymer or waste terephthalate polymer, 10–40% by weight of at least one glycol and 5–25% by weight of at least one oxyalkylated polyol.

26 Claims, No Drawings

PREVENTION OF DYE REDEPOSITION IN FABRIC WASHING PROCESSES

FIELD OF THE INVENTION

The present invention relates to a fabric washing composition and process for preventing the deposition of dye onto fabric in a fabric washing process. More specifically, this invention relates to the use of one or more water-soluble or water-dispersible polyester resin in a fabric washing process to inhibit dye bleed-off from dyed fabric and from redepositing onto another fabric or to a different location on the same fabric.

BACKGROUND OF THE INVENTION

It is known that the clothing made from cellulosic fabrics such as cotton, in particular, indigo dyed denim can be treated by fabric finishing processes such as prewashing or stonewashing to release dye from the fabric. Such treatment can accomplish a preworn and softer effects that have been preferred by consumers for many years. Indigo blue is the most common dye that is released in the fabric finishing process. Other dyes such as sulfur black are also used to color denim and could also be released in a stonewashing or prewashing process.

In a stonewashing process, fabric, usually denim, is treated to intentionally release dye from the fabric to non-uniformly fade the fabric. This process may also soften the fabric and make the fabric surface appear fuzzy and worn.

In a prewashing process, excess dye is removed from the fabric uniformly to fade the fabric. This process may also be used to soften the fabric by removing the sizing agent present in the fabric, to remove stiffening agent or to preshrink the fabric. Compared to the prewashing process, stonewashing process produces a more preworn look.

A common problem in both stonewashing and prewashing processes is that the released dyes can redeposit back on the same or different fabric. For example, when stone washing blue jeans, the released dye tends to redeposit onto the denim and white pocket liners. Because of the deposition, the pocket liners become undesirably colored and the denim has a darker appearance on the seams of the clothing. The problem of dye redeposition in stonewashing and prewashing is more severe because the concentration of dye in the wash bath of both processes is at least 100 percent higher than in a typical household laundry process.

Consequently, efforts have been made to seek a fabric washing process and a dye deposition inhibiting agent that can be effective in preventing dye from redepositing on fabrics during the washing process.

U.S. Pat. No. 4,444,561 to Denzinger et al. issued Apr. 24, 1984, discloses a process for washing and after-treating textile goods containing synthetic fibers, which utilizes a copolymer as an antiredeposition agent to inhibit the resoiling of the wash with the dirt particles and fats, particularly in the case of fabrics containing synthetic fibers. The copolymer being employed comprises: (a) from 50 to 90% by weight of one or more vinyl esters of $C_1$, to $C_4$ aliphatic carboxylic acids, (b) from 5 to 35% by weight of one or more N-vinyl lactams, (c) from 1 to 20% by weight of one or more monomers containing basic groups, or of salts or quaternization products of these monomers, and (d) from 0 to 20% by weight of one or more further monomers which are copolymerizable with monomers (a), (b) and (c) and are free from carboxyl and basic groups.

U.S. Pat. No. 4,925,588 to Berrod et al. issued on May 15, 1990, discloses an antisoiling and anti-redeposition agent which is useful for the aqueous washing of textile articles to avoid the redeposition of the soiling removed during washing on the textile fibers. The antisoiling and anti-redeposition agent comprises a vinyl copolymer of at least one (meth)acrylic ester and at least one unsaturated carboxylic acid grafted with at least 1% polyester sulfonate.

U.S. Pat. No. 5,730,760 to Kirk et al. issued on Mar. 24, 1998, provides a fabric washing composition and aqueous treatment solution for inhibiting deposition of dye, comprising at least one dye deposition inhibiting polymer. The dye deposition inhibiting polymer comprises, as polymerized units, from 5 to 100 weight percent of at least one vinyl amide monomer and from 0 to 95 weight percent of one or more vinyl ester monomers.

It is an object of the present invention to provide a fabric or garment washing composition containing one or more dye deposition inhibiting agents which can be added during fabric finishing processes to effectively inhibit the deposition of dye during these processes.

A further aspect of this invention is to provide a process for washing dyed fabric or garments consisting of natural fibers to inhibit the deposition of released dyes onto the fabric during prewashing or stonewashing.

We have surprisingly found that these objects are achieved by the use of at least one water-soluble or water-dispersible polyester resin disclosed in U.S. Pat. No. 4,977,191 in a wash liquor as a dye deposition inhibiting agent.

SUMMARY OF THE INVENTION

In one aspect, this invention relates to a process for washing dyed fabric or garments consisting of or containing natural fibers, wherein, a water-soluble or water-dispersible polyester resin composition is employed as a dye redeposition inhibiting agent, said polyester resin composition comprising a reaction product of 20%–50% by weight of terephthalate polymer or waste terephthalate polymer, 10–40% by weight of at least one glycol and 5–25% by weight of at least one oxyalkylated polyol. Preferred resins also comprise 20–50% by weight of isophthalic acid.

In a further aspect, this invention relates to a fabric or garment washing composition for inhibiting redeposition of dye, comprising: (A) at least one additive selected from the group consisting of a surfactant, fabric softening agent, enzymes and combinations thereof; and (B) from 0.01 to 20 weight percent, based on the total weight of the composition, of at least one dye redeposition inhibiting agent, which is a water-soluble or water-dispersible polyester resin comprising a reaction product of 20%–50% by weight of terephthalate polymer or waste terephthalate polymer, 10–40% by weight of at least one glycol and 5–25% by weight of at least one oxyalkylated polyol. Preferred resins also comprise 20–50% by weight of isophthalic acid.

This invention further relates to an aqueous treatment solution for inhibiting the redeposition of dye onto a fabric or garment being treated in a fabric or garment washing process, comprising: (1) water and (2) from 1 ppm to 10,000 ppm of at least one dye deposition inhibiting agent as described above.

In another aspect, this invention relates to a process for preventing the redeposition of a dye onto a fabric being treated in a fabric washing process, comprising:

(1) forming an aqueous bath comprising (a) water, (b) dyed fabric, and (c) at least one dye redeposition inhibiting agent as described above (1) treating the dyed fabric in said aqueous bath and releasing a portion of the dye from the dyed fabric into said bath, and (2) substantially preventing the dye from redepositing on said dyed fabric by maintaining said dye inhibiting agent in contact with said dyed fabric for the duration of the treating step, said dye redeposition inhibiting agent in the aqueous bath being maintained at a concentration of from at least 25 to 2000 ppm based on the total weight of the aqueous bath excluding the weight of the dyed fabric.

In a further aspect, this invention relates to dyed fabric treated with the foregoing fabric washing compositions or aqueous treatment solutions containing water-soluble or water-dispersible polyester resins.

DETAILED DESCRIPTION OF THE INVENTION

We have discovered that the water-soluble or water-dispersible polyester resin composition as claimed herein, referred to hereinafter as "dye redeposition inhibiting agent", prevent dye, which is intentionally or unintentionally released in a fabric or garment finishing process including stonewashing and prewashing, from depositing onto previously dyed fabric and white or lightly colored fabric such as pocket liners. One or more dye redeposition inhibiting agents are added to a fabric washing process and fabric washing compositions as defined further herein.

The mechanism of such dye redeposition inhibition has not been clarified so far. It is believed that the polymers being employed may act to inhibit the redeposition of dye by several different mechanisms. For example, where dye is released intentionally or inadvertently from the fabric, the polymers may act to inhibit the redeposition of the released dye onto the fabric. Where dye is inadvertently released from the fabric, the polymers may inhibit the release of dye from the fabric in the fabric washing process. The term "inhibiting dye redeposition" means that the polymer may act by any mechanism, including those mechanisms specifically mentioned herein, to prevent the transfer of dye from one fabric to another fabric or to the same fabric in a different location.

The dye redeposition inhibiting agents, dye redeposition inhibiting process and fabric washing compositions are described below.

DYE REDEPOSITION INHIBITING AGENTS

The dye redeposition inhibiting agents useful in the present invention are water-soluble or water-dispersible polyester resins which are made from virgin terephthalate polymers, waste terephthalate polymers, including bottles, sheet material, textile wastes and the like. The waste terephthalate plastics may be bought from recyclers and include, but are not limited to, material identified as "PET rock." The waste terephthalate can be characterized by the unit formula

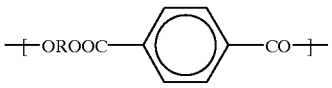

wherein R is the residue of an aliphatic or cycloaliphatic glycol of 2–10 carbons or of an oxygenated glycol of the formula $$HO(C_xH_{2x}O)_nC_xH_{2x}OH$$

wherein x is an integer from 2–4 and n is 1–10.

Preferably the terephthalate polymer or waste terephthalate polymer is polyethylene terephthalate, polybutylene terephthalate, poly-(cyclohexanedimethanol terephthalate) or a mixture thereof.

It will be understood that, for reasons of economy, the use of waste terephthalates is preferred. However, the use of virgin terephthalate resins is to be included within the scope of the disclosure and appended claims.

The glycol with which the waste terephthalate polymer is reacted can be selected from among a variety of known dihydric alcohols. Preferred glycols include, but are not limited to, ethylene glycol, diethylene glycol, triethylene glycol, cyclohexanedimethanol, propylene glycol, butylene glycol, neopentyl glycol, 1,5-pentanediol, 1,6-hexanediol or mixtures thereof. Most preferably, the glycol is a mixture of diethylene glycol and neopentyl glycol.

The oxyalkylated polyol is derived from any polyol, having three or more alcohol functions. Polyols include glycerol, trimethylolpropane, trimethylolethane, pentaerythritol, erythritol, sorbitol, mannitol, other sugar alcohols or monosaccharides. The polyols are oxyalkylated with an alkylene oxide, including, but not limited, to ethylene oxide, propylene oxide, butylene oxide, amylene oxide, etc.

Preferably, the oxyalkylated polyol is glycerol, trimethylolpropane, trimethylolethane, pentaerythritol, erythritol or a monosaccharide, oxyalkylated with 5–30 moles of ethylene oxide, propylene oxide or a mixture thereof, per hydroxyl of the polyol.

The water-soluble or water-dispersible polyester resins can further include 3–15% by weight of trimellitic acid or anhydride as well as 1–10% by weight of polyol. Polyols are chosen as above.

The polyester resins can be made by heating waste terephthalate polymer, glycol, oxyalkylated polyol and, optionally, isophthalic acid together in any order until breakdown and reconstruction of a mixed terephthalate-isophthalate ester has occurred. This process normally requires, for acceptable reaction times, temperatures above about 150° C. to the decomposition point of the ester product.

In making the water-soluble or water-dispersible polyesters, it is preferred to heat the waste terephthalate polymer, glycol and oxyalkylated polyol above about 150° C. to partially breakdown the terephthalate and then to heat the thus-produced intermediate with isophthalic acid under similar temperature conditions.

A most preferred product is that obtained by heating waste terephthalate polymer, glycol and oxyalkylated polyol above about 150° C. to produce an intermediate product, characterized by a 15-minute clear peel, and heating the thus-obtained intermediate product with isophthalic acid at a temperature of at least 150° C.

Polyester resins, containing trimellitic acid or trimellitic anhydride, are preferably made by heating an isophthalic acid-containing intermediate with trimellitic acid or trimellitic anhydride. It is preferred to obtain an intermediate, having a 15-minute clear peel, before reaction with isophthalic acid and then with trimellitic acid or anhydride.

Resins made from waste terephthalate polymer, glycol and isophthalic acid are preferably made by heating waste terephthalate polymer with at least one glycol above about 150° C. to produce an intermediate product, characterized by a 15-minute clear peel, and heating the thus-obtained intermediate product with isophthalic acid at a temperature of at least 150° C. Subsequent reaction with trimellitic acid or trimellitic anhydride is preferred.

Preferred terephthalate feeds are as above. Most preferred feeds are polyethylene terephthalate or poly (cyclohexanedimethanol terephthalate). Glycols are as recited above. Particularly preferred is a mixture of diethylene glycol and cyclohexanedimethanol.

A preferred product is that comprising a reaction product of 20–50% by weight of polyethylene terephthalate, 10–30% by weight of diethylene glycol, 20–50% by weight of isophthalic acid and 3–15% by weight of trimetllitic acid or trimellitic anhydride.

A highly-preferred water-soluble or water-dispersible polyester resin comprises a reaction product of 20–50% by weight of polyethylene terephthalate, 10–30% by weight of diethylene glycol, 1–10% by weight of pentaerythritol, 5–25% by weight of oxyalkylated glycerol of 5–30 oxyalkyl units per hydroxyl, 20–50% by weight of isophthalic acid and 3–15% by weight of trimellitic acid or trimellitic anhydride.

The polyester resins are usually and preferably made using an ester-interchange catalyst. These catalysts are well known organometallic compounds, particularly compounds of tin or titanium. Preferred catalysts include tetraalkyl titanates, in which the alkyl is of up to 8 carbon atoms, as well as alkyl stannoic acids or dialkyl tin oxides, such as monobutyl stannoic acid or dioctyl tin oxide. Preferred catalysts include monobutyl stannoic acid and tetrapropyl or tetrabutyl titanate, or a mixture thereof.

The resinous products obtained are generally taken up in relatively concentrated aqueous solutions of alkali metal or ammonium hydroxides or carbonates. The concentration employed can be determined by routine experimentation. However, if shipping of the concentrated aqueous solutions to a point of use is contemplated, it is preferred to produce highly concentrated solutions. It is within the scope of this invention to produce initial solutions or dispersions, containing 20–30% or more of resin solids.

DYE REDEPOSITION INHIBITING PROCESS

Generally, the dye redeposition inhibiting agents can be used in any step of the fabric washing process where dye is intentionally or unintentionally released from fabric into an aqueous solution containing the fabric. This aqueous solution containing the fabric being treated is herein called the "bath" or "aqueous bath". For instance, the dye deposition inhibiting agents may be added to the bath where fabric is stonewashed; prewashed; cleaned; or softened.

The amount of dye redeposition inhibiting agent added to the aqueous bath is that concentration sufficient to inhibit the redeposition of dye. This concentration will be varied in terms of the concentration of released dye. Preferably, in a fabric washing process, from 1 to 10,000 ppm; more preferably from 10 to 5000 ppm, and most preferably from 25 to 2000 ppm by weight of at least one dye redeposition inhibiting agent is added to the aqueous bath based on the total weight of the aqueous bath excluding the weight of the dyed fabric.

To inhibit dye redeposition, the dye redeposition inhibiting agents are brought into contact with the fabric and in contact with any released dye in the bath. Contacting is preferably accomplished through agitation of the bath.

The amount of time required for contact of the released dye and fabric with the dye redeposition inhibiting agents is that time necessary to treat the fabric. For instance, in a stonewashing process, the wash cycle may take from about 30 to 60 minutes to releases the desired amount of dye. In a prewashing process, the wash cycle may take from about 15 to about 30 minutes to complete.

The dye redeposition inhibiting agents are preferably effective in inhibiting dye redeposition at temperatures ranging from about 5° C. to about 95° C. Additionally, the dye redeposition inhibiting agents are preferably effective in preventing the redeposition of dye at aqueous bath pH levels ranging from about 3 to about 13.

FABRIC WASHING COMPOSITIONS

The dye redeposition inhibiting agents may be added to the fabric washing process as a fabric washing composition.

Fabric washing compositions are composed of (A) at least one additive selected from the group consisting of a surfactant, fabric softening agent, enzymes and combinations thereof; and (B) from 0.01 to 45 weight percent, based on the total weight of the composition, of at least one dye redeposition inhibiting agent.

A fabric washing composition is intended for fading fabric may comprise from 0 to about 50 percent by weight of one or more surfactants. Suitable surfactants include nonionic, anionic, cationic, and amphoteric surfactants.

Nonionic surfactants include for example from $C_6$ to $C_{12}$ alkylphenol ethoxylates, from $C_{12}$ to $C_{20}$ alkanol alkoxylates, and block copolymers of ethylene oxide and propylene oxide. The nonionic surfactants also include $C_4$ to $C_8$ alkyl glucosides as well as their alkoxylated products.

Anionic surfactants are surfactants having a hydrophilic functional group in a negatively charged state in an aqueous solution. Commonly available anionic surfactants include carboxylic acids, sulfonic acids, sulfuric acid esters, phosphate esters, and salts thereof.

Cationic surfactants contain hydrophilic functional groups where the charge of the functional groups are positive when dissolved or dispersed in an aqueous solution. Typical cationic surfactants include for example amine compounds, oxygen containing amines, and quaternary amine salts.

Amphoteric surfactants contain both acidic and basic hydrophilic groups and can be used in fabric washing compositions.

The washing compositions contain enzymes well known in the art selected from the group consisting of amylases, cellulases, proteases and lipases.

A fabric washing composition used for softening fabric may comprise from 25 to 95 weight percent water; from 2 to 60 weight percent of at least one fabric softening agent, and from 0.01 to 20 weight percent of at least one dye redeposition inhibiting agent.

The dye redeposition inhibiting agents of the present invention are effective in preventing the redeposition of indigo blue which is classified as vat type dye, belonging to nonionic dyes. However, more generally, the dye redeposition inhibiting agents are effective in preventing the deposition of dyes when the dyes are nonionic.

BEST MODE FOR CARRYING OUT THE INVENTION

The following examples will more fully illustrate the embodiments of this invention. Therefore, they should not be construed as limiting of the remainder of the disclosure in any way. All parts, percentage and proportions referred to herein and in the appended claims are by weight unless otherwise indicated.

SYNTHESIS OF ANTIREDEPOSITION AGENTS

EXAMPLE 1

Preparation of Water-soluble Resin from Scrap Polyethylene Terephthalate

The following ingredients are used:

| parts by weight | |
|---|---|
| 19.05 | diethylene glycol |
| 5.04 | neopentyl glycol |
| 2.18 | pentaerythritol |
| 11.01 | ethoxylated glycerine (17–19 moles of ethylene oxide, molecular weight 850, Witco Chemical Co., Witconol (4073)) |
| 0.08 | monobutyl stannoic acid |
| 30.47 | scrap polyethylene terephthalate |
| 25.87 | isophthalic acid |
| 6.2 | trimellitic anhydride |
| 0.1 | tetrapropyl titanate |

The alcohols are charged to a reaction vessel and heated to 200° C. to remove water. Titanate catalyst is charged to the hot alcohol mixture, after which PET is added in three batches. The initial third of the PET is added to the alcohols at 200° C., whereupon the temperature in the reactor is increased to 240° C. and maintained at 240° C. for 15 min. Half of the remaining PET is added and the temperature is kept at 240° C. for 15 min more, after which the remaining third of the PET is added. The temperature in the reactor is kept at 240° C. until a 15-minute clear peel is obtained.

Clear peel time is determined by placing a drop of the reaction mixture on a Petri dish and starting a timer. The time at which the drop becomes opaque is the limit of the clear peel.

When the 15-minute clear peel is obtained, the temperature in the reactor is reduced to 185° C. and monobutyl stannoic acid and then isophthalic acid are charged to the reactor. The resulting mixture is heated until an acid value of 15–20 is obtained. The resulting mixture is cooled to 180° C. and the trimellitic anhydride is charged to the reactor. At the end of 30 minutes, all of the trimellitic anhydride has reacted. The resulting resinous mixture is dissolved to a level of 25% solids in aqueous ammonia solution.

EXAMPLE 2

Preparation of Water-soluble Resin from Scrap Polybutylene Terephthalate

The following materials are used:

| parts by weight | |
|---|---|
| 20.0 | triethylene glycol |
| 5.0 | neopentyl glycol |
| 2.5 | trimethylolpropane |
| 11.5 | ethoxylated trimethylolpropane (10 moles of ethylene oxide) |
| 0.1 | monohexyl stannoic acid |
| 29.5 | scrap polybutylene terephthalate |
| 30.0 | isophthalic acid |
| 1.0 | tetra(isopropyl) titanate |

The PBT is broken down as in Example 1 to produce a resinuous material, which is taken up in dilute sodium hydroxide solution to produce a stable dispersion.

EXAMPLE 3

Preparation of Water-soluble Resin from Scrap Poly (cyclohexanedimethanol Terephthalate)

The following ingredients are used:

| parts by weight | |
|---|---|
| 25.0 | ethylene glycol |
| 20.0 | ethoxylated pentaerythritol (15 moles of ethylene oxide) |
| 30.0 | scrap poly(cyclohexanedimethanol terephthalate) |
| 24.8 | isophthalic acid |
| 0.2 | tetrabutyl titanate |

The procedure of Example 1 is followed. The resinous product obtained is dissolved in aqueous KOH solution, to a solids content of 20%.

EXAMPLE 4

Preparation of Water-soluble Resin from Scrap Polyethylene Terephthalate

The following ingredients are used:

| parts by weight | |
|---|---|
| 11.0 | diethylene glycol |
| 21.55 | cyclohexanedimethanol |
| 30.0 | scrap polyethylene terephthalate |
| 0.08 | monobutyl stannoic acid |
| 3.91 | polyethylene glycol (Pluracol PEG 4000) |
| 0.1 | tetrapropyl titanate |
| 23.36 | isophthalic acid |
| 10.0 | trimellitic anhydride |

The glycols are charged to a reactor and heated to 200° C. to remove water. Titanate catalyst is charged to the reactor, after which one third of the PET is added and the temperature in the reactor is raised to 240° C. After 15 minutes' heating at this temperature, half of the remaining PET is charged to the reactor. After 15 minutes more, the rest of the PET is added. The temperature in the reactor is kept at 240° C. until a 15-minute clear peel is obtained.

The temperature in the reactor is dropped to 185° C. Monobutyl stannoic acid is charged to the reactor, followed by the isophthalic acid. The mixture in the reactor is cooked until an acid value of 15–20 is obtained. The temperature may be raised to 220° C. during this step. The resulting product is cooled to 180° C. and the trimellitic anhydride is added. After 1 hr at this temperature, all of the trimellitic anhydride has reacted. The resulting resin is ground into a coarse powder, which is blended with sodium carbonate.

EXAMPLE 6

Preparation of Water-soluble Resin from Scrap Poly (Cyclohexanedimethanol Terephthalate)

The following ingredients are used:

| parts by weight | |
|---|---|
| 20.0 | tetraethylene glycol |
| 0.1 | monobutyl stannoic acid |
| 0.1 | tetrabutyl titanate |
| 40.0 | scrap poly(cyclohexanedimethanol terephthalate) |
| 35.0 | isophthalic acid |
| 3.0 | trimellitic anhydride |

A resin is prepared as in Example 5. The hot resin is taken up in ammonium hydroxide solution to a solids content of 27%.

EXAMPLE 7

Preparation of Water-soluble Resin from Scrap Polybutylene Terephthalate

The following materials are used:

| parts by weight | |
|---|---|
| 15.0 | ethylene glycol |
| 12.0 | neopentyl glycol |
| 40.0 | scrap PBT |
| 32.0 | isophthtalic acid |
| 0.1 | monobutyl stannoic acid |
| 0.1 | tetrapropyl titanate |

The resinous product, obtained as in Example 5, is chopped up into a coarse powder and blended with potassium carbonate.

Generally, the dye redeposition inhibiting agents were tested at typical wash and rinse conditions for prewashing and stonewashing processes. For example, stonewash tests were performed at an acidic pH of 4.5 to 5.5 because acidic pH conditions are typical for a stonewash process. Prewash tests were performed at a pH of 11.8 because basic pH conditions are typical for a prewash process.

EXAMPLE 8

Preparation of Water Soluble Resin From Monomers

The following materials are used to make a water soluble polyester resin:

| Components | % by weight |
|---|---|
| PEG 1450 | 59.81 |
| Ethylene glycol | 11.94 |
| Fastcat 4100 | 0.10 |
| Terephthalic Acid | 18.27 |
| Isophtahlic acid | 9.14 |
| Cyanox | 0.74 |
| | Post added anti-oxidant |

The above components are polycondensed using standard polymerization techniques well known in the polyester art.

EXAMPLE 9

Following the procedure of Example 4, the following materials are used to make a water soluble polyester resin:

| Components | % by weight |
|---|---|
| PEG 1450 | 60.87 |
| PET Virgin | 25.86 |
| Ethylene glycol | 3.76 |
| Fastcat 4100 | 0.11 |

-continued

| Components | % by weight |
|---|---|
| Tetrapropyl titanate | 0.09 |
| Isophtahlic acid | 9.31 |

Test Conditions

The equipment used for Examples 8 to 13 was a 450 lb. Washex Belly Washer. To test the efficacy of the dye redeposition inhibiting agents, denim garments dyed with indigo dye were subject to a series of wash cycles, each of which includes five major processes: pre-soak, desize, abrasion, soften and cleaning. The dye redeposition inhibiting agents can be added into pre-soak, desize and abrasion processes.

The pre-soak process provides lubricity, anti-creasing and anti-redeposition properties to the garments. The addition of a dye redeposition inhibiting agent in the pre-soak stage will ensure that a first coat indigo shield is applied to the garment to prevent indigo dye from bleeding during initial desizing. The amount of dye redeposition inhibiting agent needed to add in this process might be determined depending on the tendency of garments to streak and the tendency of the fabric to bleed during this process. Typically, 0.5% to 3% by weight of dye redeposition inhibiting agent is preferably employed.

The dye redeposition inhibiting agents are used in combination with alpha-amylase and/or chemical desize formula in the desize process, thereby providing anti-redeposition and lubricity to the garment wash bath. Typical usage is 1% by weight during this process. The dye redeposition inhibiting agents are also used in combination with other washing enzymes such as the proteases.

The abrasion process referred herein is a stonewashing process using chemical stone and/or other abrasives such as diatomaceous earth. The incorporation of dye redeposition inhibiting agents combined with enzymes in this process enables the enzymes to attack the cellulosic fibers of the garments while keeping the released indigo dye from redepositing on pocketing, filling yarn, labeling, thread, and the like during the abrasion process. Based on all trial work done so far, it is observed that the dye redeposition inhibiting agents of this invention are completely compatible with both alpha amylase and cellulase enzymes formulations. There is no negative effect on enzymatic activity when using this product. The ratio of dye redeposition inhibiting agent to the enzyme dosage is preferably in the range of 0.5:1 to 1:1.

The wash cycle processes and conditions are summarized below in Table 1.

TABLE 1

Wash Cycle Processes And Conditions

| Process | Time (min.) | Water level | Temp. (° F.) | pH range | Added product | Amount (oz.) |
|---|---|---|---|---|---|---|
| Pre-soak | 10 | 8:1 | 120 | 6.5–7.5 | Seycote[1] | 40 |
| Desize | 10 | 6:1 | 140 | 6.5–7.5 | Seycozyme[2] | 18 |
| | | | | | Seycofilm SRS[3] | 16 |
| Drop and rinse | | | | | | |
| Abrasion | 35–40 | 4:1 | 135 | 4.5–5.5 | Seycozyme Biocell[4] | 28 |
| | | | | | Seycofilm SRS | 16 |

TABLE 1-continued

| Wash Cycle Processes And Conditions | | | | | | |
|---|---|---|---|---|---|---|
| Process | Time (min.) | Water level | Temp. (° F.) | pH range | Added product | Amount (oz.) |
| Drop and rinse | | | | | | |
| Bleach to standard and neutralize | | | | | | |
| Cleaning | 10 | | | | Seyco Scour[5] | 8 |
| | | | | | Self supp. OB | 28 gr. |
| Softening | 10 | | | | Seyco Soft SC or SILK[6] | 64 |

[1]. Uses additives that provide lubricity, anti-creasing and anti-redeposition properties to laundries. This presoak also includes the polyester of Example 8.
[2]. Enzymatic solution containing an amylase enzyme.
[3]. Polyester resin of Example 8.
[4]. A cellulase enzyme containing treating agent.
[5]. Non-ionic detergent treatment
[6]. Fabric softerners containing cationic softeners and optionally silicones.

Examples 10 to 15

Efficacy of Antiredeposition Agents

The efficacy of water-soluble or water-dispersible polyester resins containing products as antiredeposition agents were tested at different conditions and processes in the wash cycle as shown Examples 1 to 6. The equipment used was 450 lb. Washex Belly Washer. Load size was 60 denim garments (30 per pocket). The effectiveness of the addition of the antiredeposition agent into the respective processes such as pre-soak, desize and abrasion can be determined by directly observing the appearance of pockets, labels and threads of treated garments after each complete wash cycle, which indicates the degree of redeposition of released indigo dye onto the treated garments during the washing treatment. The results of Examples 10 to 15 are listed below in Table 2.

TABLE 2

| Efficacy of Anti-redeposition Agent | | | | |
|---|---|---|---|---|
| | Amount of Anti-redeposition Agent (oz.) | | | |
| Example No. | Pre-soak | Desize | Abrasion | Observation |
| Example 10 | — | 30 | 30 | Not dyed |
| Example 11 | — | 30 | 30 | Not dyed |
| Example 12 | 40 | 30 | 45 | Very Bright |
| Example 13 | — | 45 | 45 | Bright |
| Example 14* | 45 | 45 | 45 | Very Bright |
| Example 15 | — | 45 | 45 | Bright |

*omitted rinse step after abrasion.

As can be seen from table 2, a significant reduction or elimination of the undesired dye redeposition during washing treatment of indigo dyed denim has been accomplished by utilizing an anti-redeposition agent of this invention. In particular, in the case of usage of the anti-redeposition agent of this invention in all three processes, i.e. pre-soak, desize and abrasion stages (see Example 5), the rinse step after abrasion was deleted and the bleaching process was directly performed. Based on the calculation, this will result in 7.5 minutes reduction in one wash cycle as well as saving 320 gallons of water and energy consumption. It would be also possible to delete the rinse step after bleaching process, therefore, to further shorten wash cycle time and save significant energy and water consumption per load. So it comes to a conclusion that the application of the water-soluble or water-dispersible polyester resins as dye redeposition inhibiting agents to the pre-soak, desize and abrasion processes, particularly to the synergistic combination of desize and abrasion bath, can provide a treated garment with premium quality such as whiter pockets and greater garment contrast, shorten abrasion cycle and reduce rinse steps needed after processing, and improve physical strength of garments after processing.

From the foregoing description, one skilled in the art can easily ascertain the essential characteristics of this invention. A further understanding of the nature and advantage of this invention herein may be realized by reference to the remaining portions of the specification and the appended claims.

I claim:

1. A process for preventing dye redeposition during the washing of a dyed fabric or garment made from natural fibers, which process comprises adding from 1 to 10,000 parts per million of at least one dye redeposition inhibiting agent to an aqueous bath based on the total weight of the aqueous bath excluding the weight of the dyed fabric, wherein said dye redeposition inhibiting agent is a water-soluble or water-dispersible polyester resin composition comprising a reaction product of 20%–50% by weight of terephthalate polymer or waste terephthalate polymer, 10–40% by weight of at least one glycol, 5–25% by weight of at least one oxyalkylated polyol 20–50% by weight of isophthalic acid, and 3–15% by weight of trimellitic acid or trimellitic anhydride.

2. The process of claim 1, wherein the waste terephthalate polymer has a unit formula

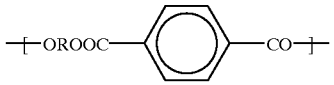

wherein R is the residue of an aliphatic or cycloaliphatic glycol of 2–10 carbons or of an oxygenated glycol of the formula $$HO(C_xH_{2x}O)_nC_xH_{2x}OH,$$

wherein x is an integer from 2–4 and n is 1–10.

3. The process of claim 1, wherein the waste terephthalate polymer is polyethylene terephthalate, polybutylene terephthalate, poly(cyclohexane dimethanol terephthalate) or a mixture thereof.

4. The process of claim 1, wherein the glycol is ethylene glycol, diethylene glycol, triethylene glycol, cyclohexanedimethanol, propylene glycol, butylene glycol, neopentyl glycol, 1,5-pentanediol, 1,6-hexanediol or a mixture thereof.

5. The process of claim 1, wherein the glycol is a mixture of diethylene glycol and neopentyl glycol.

6. The process of claim 1, wherein the oxyalkylated polyol is glycerol, trimethylolpropane, trimethylolethane, pentaerythritol, erythritol or a monosaccharide, oxyalkylated with 5–30 moles of ethylene oxide, propylene oxide or a mixture thereof, per hydroxyl of the polyol.

7. The process of claim 1, wherein the water-soluble or water-dispersible polyester resin further comprises 1–10% by weight of a polyol.

8. The process of claim 1, wherein the water-soluble or water-dispersible polyester resin comprises a reaction product of 20–50% by weight of polyethylene terephthalate, 10–30% by weight of diethylene glycol, 1–10% by weight of pentaerythritol, 5–25% by weight of oxyalkylated glycerol of 5–30 oxyalkyl units per hydroxyl, 20–50% by weight of isophthalic acid and 3–15% by weight of trimellitic acid or trimellitic anhydride.

9. The process of claim 1, wherein the water-soluble or water-dispersible polyester resin comprises a reaction product of 25–40% by weight of polyethylene terephthalate, 20–30% by weight of diethylene glycol, 1–10% by weight of pentaerythritol, 5–15% by weight of oxyethylated glycerine having 5–30 oxyethylene units per hydroxyl, 20–30% by weight of isophthalic acid and 5–10% by weight of trimellitic acid or trimellitic anhydride.

10. A process for washing a dyed fabric or garment containing natural fibers, wherein said process comprises adding from 1 to 10,000 parts per million of at least one dye redeposition inhibiting agent to an aqueous bath based on the total weight of the aqueous bath excluding the weight of the dyed fabric, wherein said dye redeposition inhibiting agent is, a water-soluble or water-dispersible polyester resin composition which comprises a reaction product of 20%–50% by weight of waste terephthalate polymer, 10–40% by weight of at least one glycol 5–25% by weight of at least one oxyalkylated polyol, 20–50% by weight of isophthalic acid, and 3–15% by weight of trimellitic acid or trimellitic anhydride.

11. The process of claim 10, wherein the waste terephthalate polymer has a unit formula

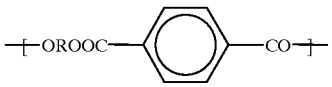

wherein R is the residue of an aliphatic or cycloaliphatic glycol of 2–10 carbons or of an oxygenated glycol of the formula $$HO(C_xH_{2x}O)_nC_xH_{2x}OH,$$

wherein x is an integer from 2–4 and n is 1–10.

12. The process of claim 10, wherein the waste terephthalate polymer is polyethylene terephthalate.

13. The process of claim 10, wherein the glycol is ethylene glycol, diethylene glycol, triethylene glycol, cyclohexanedimethanol, propylene glycol, butylene glycol, neopentyl glycol, 1,5-pentanediol, 1,6-hexanediol or a mixture thereof.

14. The process of claim 10, wherein the glycol is a mixture of diethylene glycol and cyclohexanedimethanol.

15. The process of claim 10, wherein the water-soluble or water-dispersible polyester resin composition comprises a reaction product of 20–50% by weight of polyethylene terephthalate, 10–30% by weight of diethylene glycol, 20–50% by weight of isophthalic acid and 3–15% by weight of trimellitic acid or trimellitic anhydride.

16. The process of claim 10, wherein the water-soluble or water-dispersible polyester resin composition comprises a reaction product of 20–50% by weight of poly (cyclohexanedimethanol terephthalate), 15–30% by weight of diethylene glycol, 20–50% by weight of isophthalic acid and 3–15% by weight of trimellitic acid or trimellitic anhydride.

17. The process of claim 10, wherein the water-soluble or water-dispersible polyester resin composition comprises a reaction product of 20–40% by weight of polyethylene terephthalate, 15–25% by weight of diethylene glycol, 20–30% by weight of isophthalic acid and 3–15% by weight of trimellitic acid or trimellitic anhydride.

18. The process of claim 10, wherein the water-soluble or water-dispersible polyester resin composition comprises a reaction product of 20–40% by weight of poly (cyclohexanedimethanol terephthalate), 15–20% by weight of ethylene glycol, 20–30% by weight of isophthalic acid and 3–15% by weight of trimellitic acid or trimellitic anhydride.

19. A fabric and garment washing composition useful for inhibiting redeposition of dyes, comprising: (A) a surfactant; (B) an enzyme; a fabric softening agent; and (D) from 0.01 to 45 weight percent, based on the total weight of the composition, of at least one dye deposition inhibiting agent comprising a water-soluble or water-dispersible polyester resin which comprises a reaction product of 20%–50% by weight of waste terephthalate polymer, 10–40% by weight of at least one glycol, 5–25% by weight of at least one oxyalkylated polyol 20–50% by weight of isophthalic acid, and 3–15% by weight of trimellitic acid or trimellitic anhydride.

20. A process for preventing the redeposition of a dye onto a fabric or garment being treated in a fabric or garment washing process, comprising:

forming an aqueous bath comprising (a) water, (b) dyed fabric, and (c) at least one dye redeposition inhibiting agent which is a water-soluble or water-dispersible polyester resin, comprising a reaction product of 20%–50% by weight of waste terephthalate polymer, 10–40% by weight of at least one glycol, 5–25% by weight of at least one oxyalkylated polyol, 20–50% by weight of isophthalic acid, and 3–15% by weight of trimellitic acid or trimellitic anhydride;

(1) treating the dyed fabric or garment in said aqueous bath thereby releasing a portion of the dye from the dyed fabric into said bath, and preventing the dye from redepositing on said dyed fabric or garment by maintaining said dye inhibiting agent in contact with said dyed fabric or garment and released dye for the duration of the treating step, said dye deposition inhibiting agent in the aqueous bath being maintained at a concentration of from at least 25 to 2000 ppm based on the total weight of the aqueous bath excluding the weight of the dyed fabric or garment.

21. The process of claim 20, wherein said treating step comprises stonewashing.

22. The process of claim 20, wherein said treating step comprises prewashing.

23. The process of claim 20, wherein the dye is indigo blue.

24. The process of claim 20, wherein the dye is a vat dye.

25. The process of claim 20, wherein the fabric is cotton.

26. The process of claim 20, wherein the fabric is denim.

* * * * *